US005890949A

United States Patent [19]

Shibata

[11] Patent Number: 5,890,949

[45] Date of Patent: Apr. 6, 1999

[54] EYEGLASS LENS GRINDING MACHINE

[75] Inventor: Ryoji Shibata, Aichi, Japan

[73] Assignee: Nidek Co., Ltd., Aichi, Japan

[21] Appl. No.: 921,036

[22] Filed: Aug. 29, 1997

[30] Foreign Application Priority Data

Aug. 30, 1996 [JP] Japan ..... 8-249291

[51] Int. Cl.[6] ..... B24B 49/06

[52] U.S. Cl. ..... 451/5; 451/43; 451/240; 451/255; 451/256; 451/277

[58] Field of Search ..... 451/5, 43, 240, 451/255, 256, 277, 325, 384, 390

[56] References Cited

U.S. PATENT DOCUMENTS

| | | |
|---|---|---|
| 5,053,971 | 10/1991 | Wood et al. . |
| 5,333,412 | 8/1994 | Matsuyama . |
| 5,347,762 | 9/1994 | Shibata et al. . |

FOREIGN PATENT DOCUMENTS

| | | |
|---|---|---|
| 0 379 427 | 7/1990 | European Pat. Off. . |
| 0 576 268 | 12/1993 | European Pat. Off. . |
| 0 710 526 | 5/1996 | European Pat. Off. . |
| 2-190246 | 7/1990 | Japan . |

OTHER PUBLICATIONS

European Search Report.

*Primary Examiner*—Robert A. Rose
*Assistant Examiner*—George Nguyen
*Attorney, Agent, or Firm*—Sughrue, Mion, Zinn Macpeak & Seas, PLLC

[57] ABSTRACT

An eyeglass lens grinding machine for processing lenses to be fitted in an eyeglass frame. Frame configurational data of an eyeglass frame and layout data of a lens are input to the machine, and a layout of the lens is determined based on the frame configurational data and the layout data. An edge position of the lens in the thickness direction is obtained based on the determined layout, and lens processing data is computed based on the layout and the edge position. An insufficiency in the diameter of the lens relative to the lens processing data is detected. A predetermined reference range relative to the insufficiency is set, and a judgement is made as to whether or not the insufficiency is within the predetermined reference range. A processing command signal is entered based on the result of this judgement. When the insufficiency is detected and the processing command is entered despite the insufficiency, a grinding operation is performed with the insufficiency left, based on the lens processing data.

15 Claims, 13 Drawing Sheets

EYEGLASS LENS GRINDING MACHINE

BACKGROUND OF THE INVENTION

The present invention relates to an eyeglass lens grinding machine for processing lenses to be fitted in an eyeglass frame.

Eyeglass lens grinding machines are known that process lenses by grinding on the basis of configurational data obtained by tracing the eyeglass frame or template with an eyeglass frame tracer. Some apparatus of this type include edge position detecting means which detects the position of the edge of the lens to be processed on the basis of radius vector information from the eyeglass frame tracer. If the diameter of the lens to be processed is insufficient, the gage head of the edge position detecting means comes out of engagement with the lens, this event is notified to the operator, and then the apparatus stops the subsequent processing steps.

Thus, the conventional eyeglass lens grinding machine is adapted to refrain from processing if the lens to be processed cannot be shaped to completely fit the configuration of the eyeglass frame. However, if the insufficiency of lens diameter is of such a small degree that the tapered edge (bevel) of the lens to be processed is hidden by the peripheral groove of the eyeglass frame, the processing may be performed without any practical problems. In this case, the operator wants to process the lens but finds it impossible to do so with the conventional grinding machine. The need to perform a grinding operation despite the insufficiency of lens diameter will occur most frequently when changing frames and it is a great inconvenience if the grinding operation cannot be performed during frame changing.

SUMMARY OF THE INVENTION

The present invention has been accomplished under these circumstances and has as an object providing an eyeglass lens grinding machine that is capable of processing a lens appropriately if it is only slightly insufficient in lens diameter or if the operator wants to process it despite the insufficiency of lens diameter.

The stated object and other objects of the invention can be attained by the following.

(1) An eyeglass lens grinding machine for processing lenses to be fitted in an eyeglass frame, which comprises:

configurational data input means for inputting the frame configurational data on said eyeglass frame;

edge position detecting means for determining the edge position of a processed lens on the basis of said frame configurational data;

processing data computing means for computing the lens processing data on the basis of the position of the lens edge as determined by said edge position detecting means;

lens diameter insufficiency detecting means for detecting any insufficiency in the diameter of the lens to be processed relative to said frame configurational data;

determining means for determining whether a girding operation should be performed despite the insufficiency in lens diameter detected by said lens diameter insufficiency detecting means; and control means which, when said determining means has decided to perform the grinding operation, executes the grinding operation on the basis of the data obtained by said processing data computing means.

(2) An eyeglass lens grinding machine as recited in (1), which further includes undersized area display means which gives a graphic representation of the insufficiency of lens diameter on the basis of the result of detection by said lens diameter insufficiency detecting means.

(3) An eyeglass lens grinding machine for processing lenses to be fitted in an eyeglass frame, which comprises:

configurational data input means for inputting the frame configurational data on said eyeglass frame;

edge position detecting means for determining the edge position of a processed lens on the basis of said frame configurational data;

processing data computing means for computing the lens processing data on the basis of the position of the lens edge as determined by said edge position detecting means;

lens diameter insufficiency detecting means for detecting any insufficiency in the diameter of the lens to be processed relative to said frame configurational data;

data interpolating means by which processing data for the insufficiency of the lens diameter as detected by said lens diameter insufficiency detecting means is interpolated on the basis of the edge position as detected by said edge position detecting means; and control means for executing a grinding operation on the basis of data from said processing data computing means and said data interpolating means.

(4) An eyeglass lens grinding machine as recited in (3), wherein said edge position detecting means has a gage head in contact with the front and rear surfaces of the lens to be processed.

(5) An eyeglass lens grinding machine as recited in (3), wherein said edge position detecting means has a gage head in contact with the front and rear surfaces of the lens to be processed and detection means for detecting the movement of said gage head, and wherein said lens diameter insufficiency detecting means detects the insufficiency of lens diameter on the basis of the result of detection by said detection means.

(6) An eyeglass lens grinding machine as recited in (5), which further includes control means for rotating, relative to said lens to be processed, said gage head in forward and reverse directions from a specified point on said lens to be processed.

(7) An eyeglass lens grinding machine as recited in (3), which further includes undersized area display means which gives a graphic representation of the insufficiency of lens diameter on the basis of the result of detection by said lens diameter insufficiency detecting means.

(8) An eyeglass lens grinding machine as recited in (7), which further includes input means by which the operator enters a processing command signal.

(9) An eyeglass lens grinding machine as recited in (3), which further includes judging means for judging whether the range of insufficiency as detected by said lens diameter insufficiency detecting means exceeds a specified reference value and output means for outputting a processing command signal when the range of insufficiency is found not to exceed the specified reference level by said judging means.

(10) An eyeglass lens grinding machine for processing lenses to be fitted in an eyeglass frame, which comprises:

configurational data input means for inputting the frame configurational data on said eyeglass frame;

edge position detecting means for determining the edge position of a processed lens on the basis of said frame configurational data;

lens diameter insufficiency detecting means for detecting any insufficiency in the diameter of the lens to be processed relative to said frame configurational data;

processing data computing means for computing the data for the processing of the tapered edge of the lens to be processed on the basis of the position of the lens edge excluding the insufficiency in the diameter of the lens to be processed as detected by said lens diameter insufficiency detecting means;

control means for executing a grinding operation on the basis of processing data from said processing data computing means; and command signal generating means which generates a processing command signal.

(11) An eyeglass lens grinding machine as recited in (10), which further includes undersized area display means which gives a graphic representation of the insufficiency of lens diameter on the basis of the result of detection by said lens diameter insufficiency detecting means.

DETAILED DESCRIPTION OF THE PREFERRED EMBODIMENT

One embodiment of the present invention will now be described in detail with reference to the accompanying drawings.

General Construction of an Eyeglass Lens Grinding Machine

Figure 1:
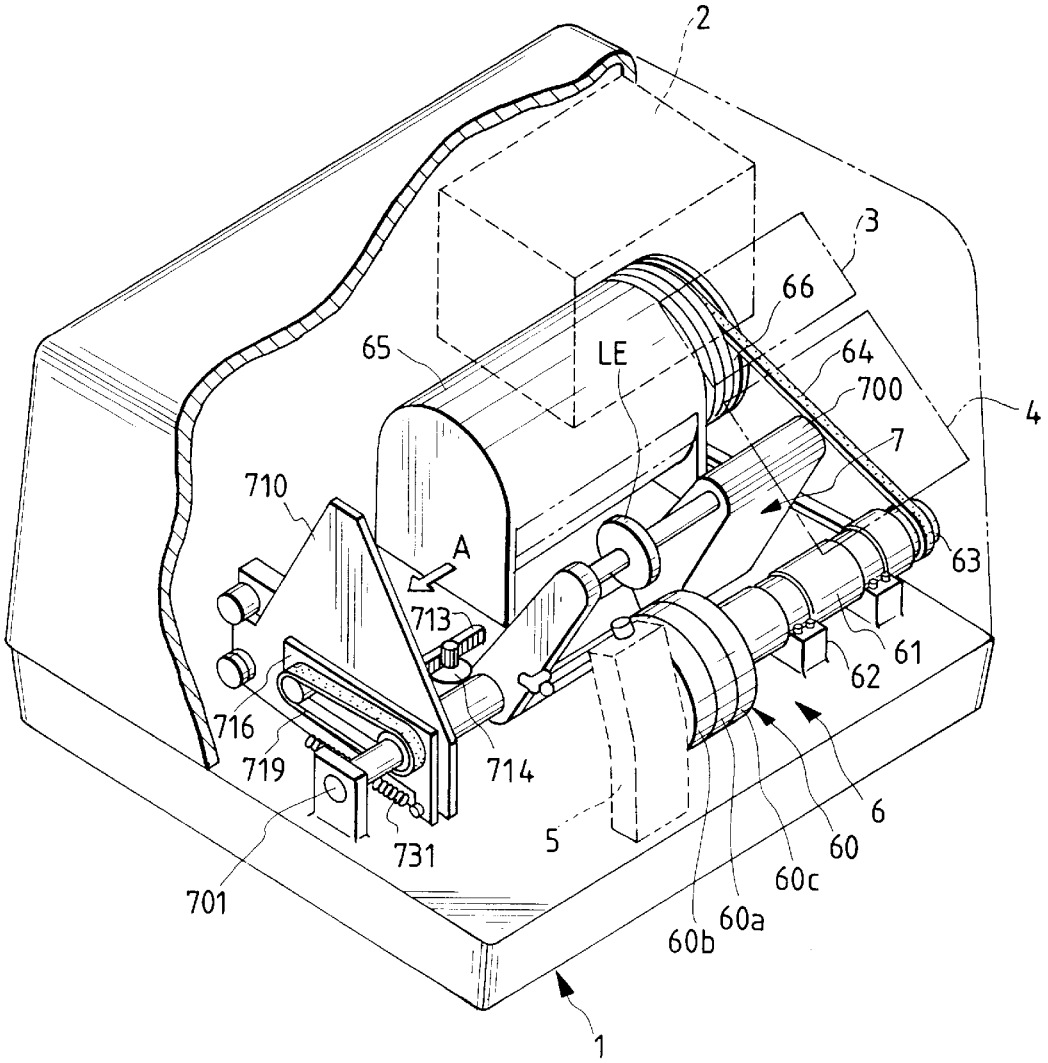
FIG. 1 is a perspective view showing the general construction of an eyeglass lens grinding machine according to an embodiment of the invention.

FIG. 1 is a perspective view showing the general construction of an eyeglass lens grinding machine in accordance with the present invention. The reference numeral 1 indicates a machine base, on which the components of the lens grinding machine are arranged.

The reference numeral 2 indicates a eyeglass frame configuration measuring device, which is arranged in the upper section of the grinding machine and which is capable of producing three-dimensional configurational data on the eyeglass frame and template (see commonly assigned U.S. Pat. No. 5,333,412). Arranged in front of the measuring device 2 are a display section 3, through which measurement results, calculation results, etc. are displayed in the form of characters or graphics, and an input section 4, at which data is entered or commands are given to the device. Provided in the front section of the grinding machine is a lens configuration measuring device 5 for measuring the imaginary edge thickness, etc. of a lens to be processed.

The reference numeral 6 indicates a lens grinding section, where an abrasive wheel means 60, which is composed of a rough abrasive wheel 60*a* for glass lenses, a rough abrasive wheel 60*b* for plastic lenses and an abrasive wheel 60*c* for tapered edge (bevel) and plane machining, is rotatably mounted on a rotating shaft 61, which is attached to the base 1 by means of fixing bands 62. Attached to one end of the rotating shaft 61 is a pulley 63, which is linked through a belt 64 with a pulley 66 attached to the rotating shaft of an AC motor 65. Accordingly, rotation of the motor 65 causes the abrasive wheel means 60 to rotate. The reference numeral 7 indicates a carriage section, and the reference numeral 700 indicates a carriage.

Construction of Main Components (A) Carriage Section

Figure 2:
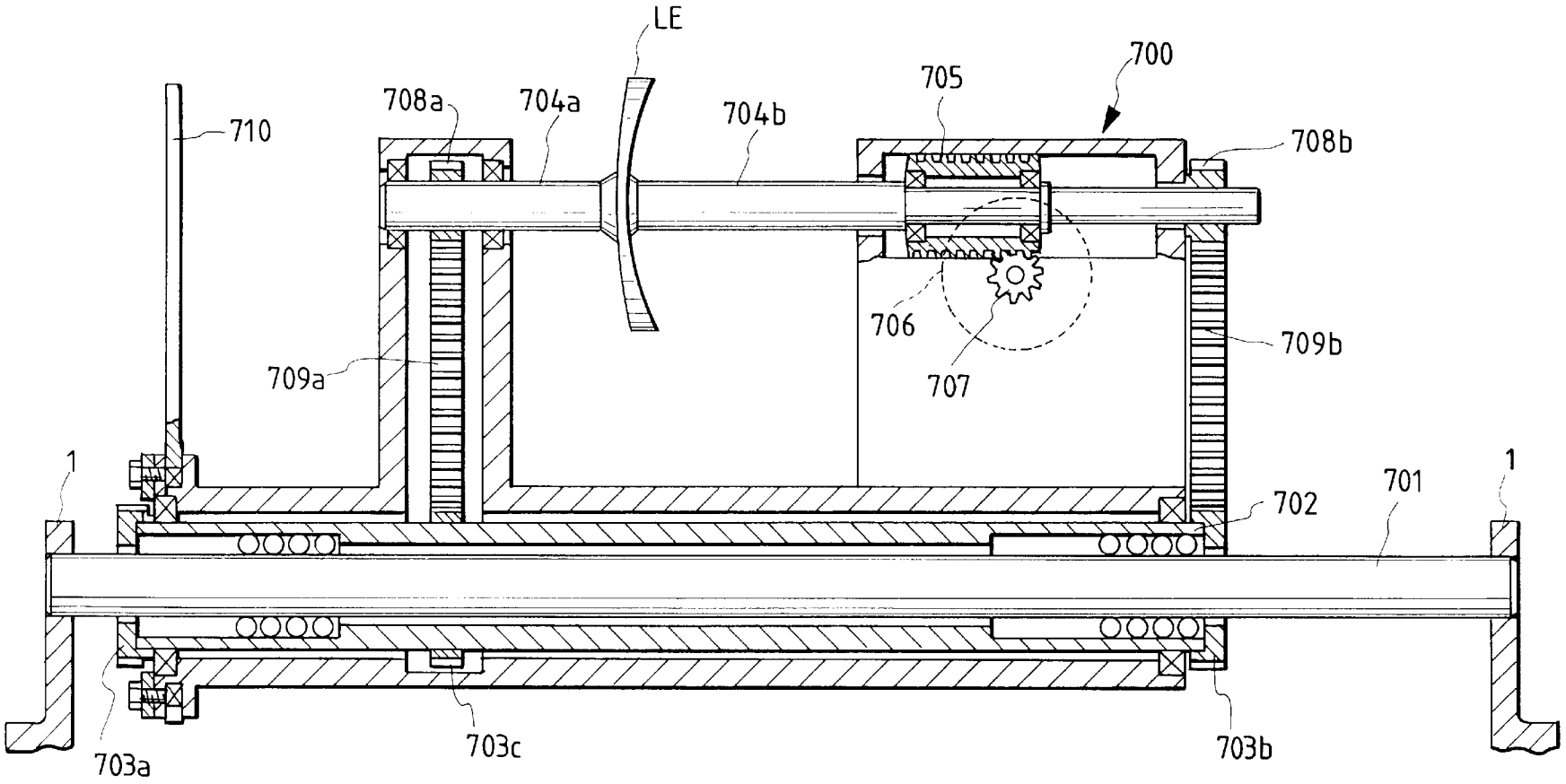
FIG. 2 is a cross-sectional view of a carriage.
Figure 3:
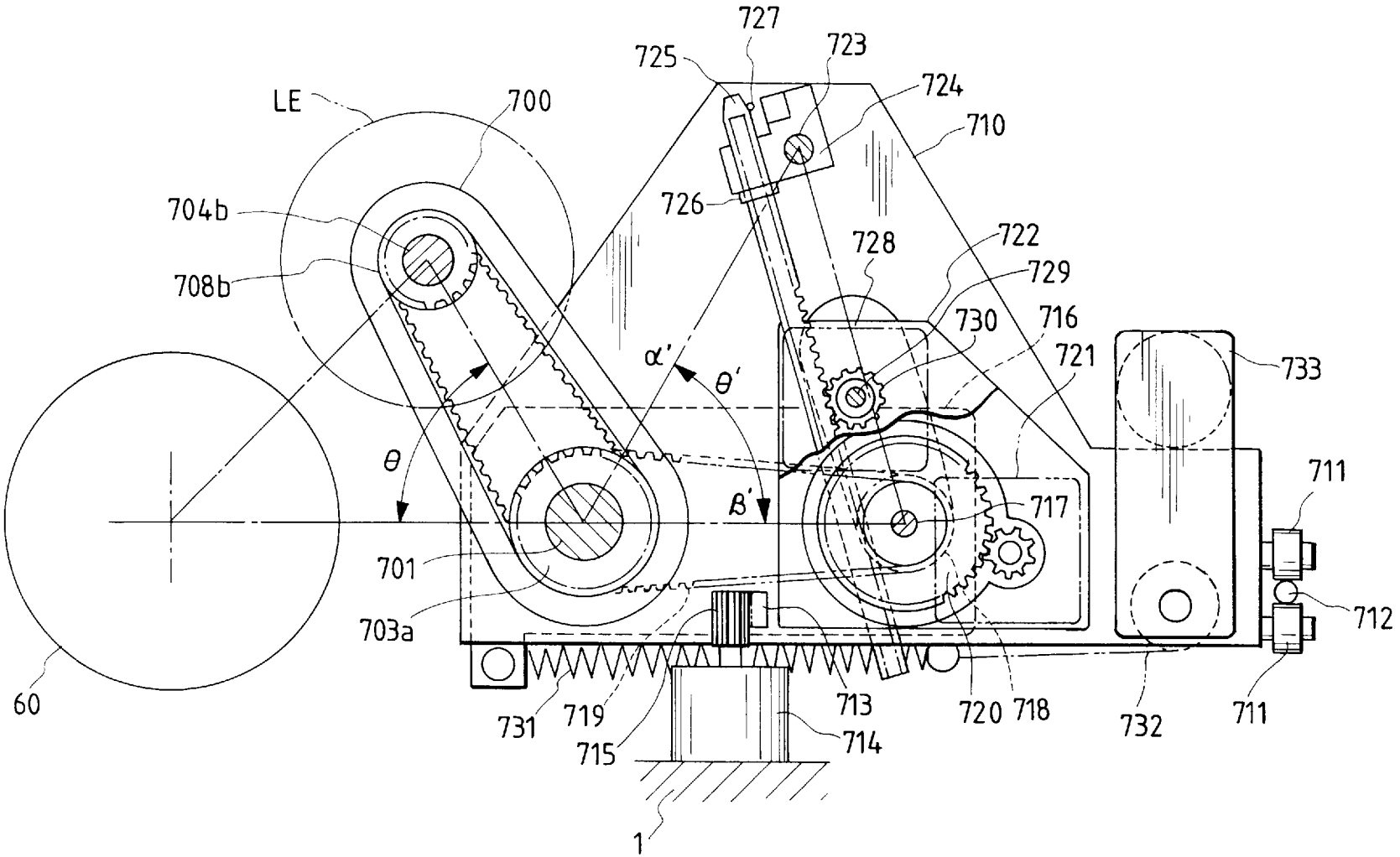
FIG. 3 is a diagram showing the drive mechanism of the carriage as viewed in the direction of arrow A.

The construction will be described with reference to FIGS. 1 to 3. FIG. 2 is a cross-sectional view of the carriage. FIG. 3 is a diagram showing a drive mechanism for the carriage, as viewed in a direction indicated by the arrow A in FIG. 1. The carriage 700 is adapted to chuck a lens LE to be processed such that it not only rotates the lens LE but also changes the distance from the rotating shaft 61 of the abrasive wheel means 60 to the lens LE, as well as the axial position of the lens.

A carriage shaft 702 is rotatably and slidably supported on a shaft 701 secured on the base 1, and further, the carriage 700 is rotatably supported on the carriage shaft 702. Timing pulleys 703*a*, 703*b* and 703*c* having the same number of teeth are fixed on a left end, a right end and an intermediate position therebetween of the carriage shaft 702, respectively. Lens rotating shaft 704*a* and 704*b* are coaxially and rotatably supported on the carriage 700, extending in parallel to and at an unchanged distance from the shaft 701. The lens rotating shaft 704*b* is rotatably supported in a rack 705 which is movable in the axial direction. The rack 705 can be moved in the axial direction by a pinion 707 fixed on a rotational shaft of a motor 706. As a result, the lens rotating shaft 704*b* moves axially either away or towards the rotating shaft 704*a* to clamp the lens LE. Pulleys 708*a* and 708*b* having the same number of teeth are provided on the lens rotating shafts 704*a* and 704*b* and linked through timing belts 709*a* and 709*b* with the pulleys 703*c* and 703*b*, respectively.

An intermediate plate 710 is rotatably fixed on the left side of the carriage 700. The intermediate plate 710 is provided with two cam followers 711 which clamp a guide shaft 712 which is secured on the base 1, extending in parallel to the shaft 701. The intermediate plate 710 includes a rack 713 which extends parallel to the shaft 701 and which meshes with a pinion 715 attached on a rotational shaft of a motor 714, secured to the base 1, for lateral movement of the carriage. With such an arrangement, the motor 714 can move the carriage 700 in the axial direction of the shaft 701.

A drive plate 716 is securely fixed on the left end of the carriage 700, and a rotational shaft 717 is rotatably provided on the drive plate 716, extending in parallel to the shaft 701. A pulley 718 having the same number of teeth as the pulleys 708*a* and 708*b* is provided on the left end of the rotational shaft 717, and the pulley 718 is linked through a timing belt 719 with the pulley 703*a*. A gear 720 is provided on the right end of the rotational shaft 717, and the gear 720 meshes with a gear attached on a motor 721. When the motor 721 is rotated, the gear 720 causes the pulley 718 to rotate so that the carriage shaft 702 is rotated through the timing belt 719, thus rotating the lens chuck shafts 704*a* and 704*b* in synchronism through the pulleys 703*c* and 703*b*, the timing belts 709*a* and 709*b*, and the pulleys 708*a* and 708*b*.

A block 722 is fixed on the drive plate 716 coaxially with the rotational shaft 717 and rotatably, and the motor 721 is secured on the block 722.

A shaft 723 is secured on the intermediate plate 710, extending in parallel to the shaft 701, and a correction block 724 is rotatably fixed on the shaft 723. A round rack 725 extends in parallel to the shortest line segment connecting the axis of the rotational shaft 717 and the axis of the shaft 723, and the round rack 725 is slidably provided, passing through a hole bored in the correction block 724. A stopper 726 is fixed on the round rack 725 so as to restrict upward sliding movement of the round rack 725 upon contact with the correction block 724. A sensor 727 is installed on the intermediate plate 710 so as to detect the contact condition between the stopper 726 and the correction block 724. Therefore, the grinding condition of the lens LE can be checked.

A pinion 730 fixed on a rotational shaft 729 of a motor 728 which is secured on the block 722 meshes with the round rack 725, so that an axial distance r' between the rotational shaft 717 and the shaft 723 can be controlled by the motor 728. Further, with this construction, a linear relation is maintained between the axial distance r' and the rotational angle of the motor 728.

A hook of a spring 731 is hung on the drive plate 716, and a wire 732 is hung on a hook on the other side of the spring 731. A drum is attached on a rotational shaft of a motor 733 secured on the intermediate plate 710, so that the wire 732 can be wound on the drum. Thus, the grinding pressure of the abrasive wheel means 60 for the lens LE can be changed.

(B) Lens Configuration Measuring Section

Figure 4:
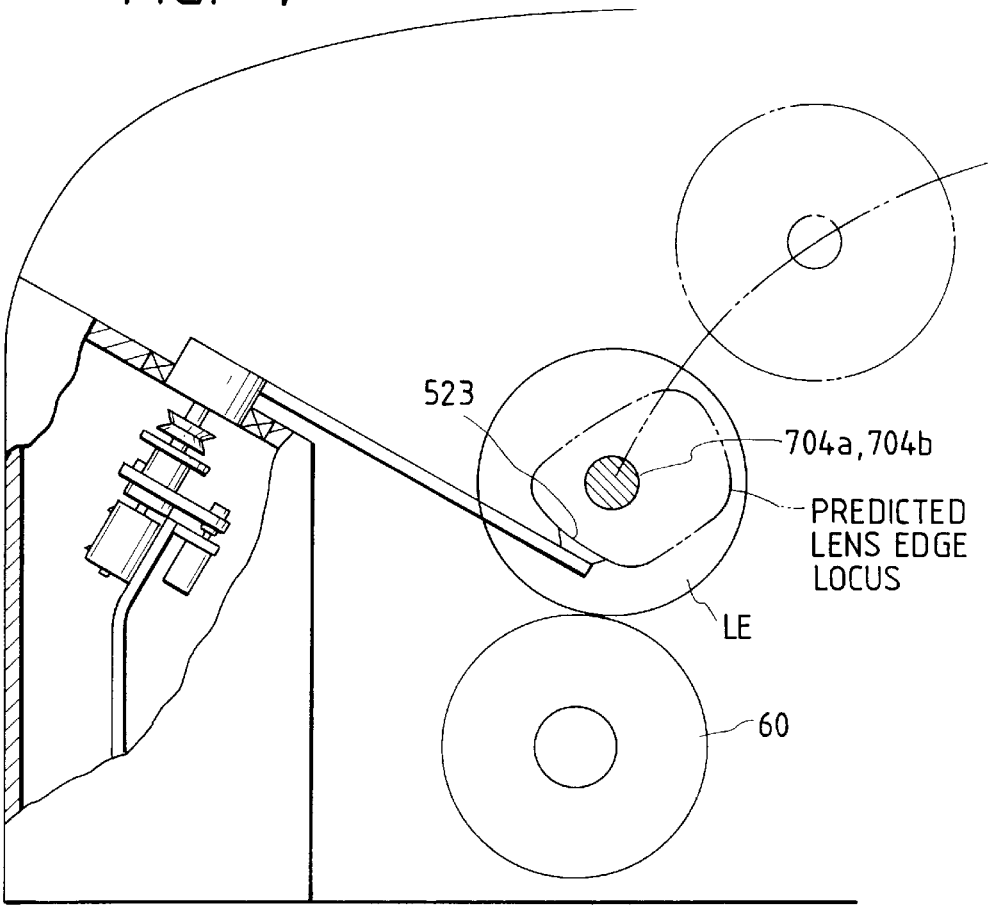
FIG. 4 is a schematic diagram showing the general construction of a lens configuration measuring section.
Figure 5:
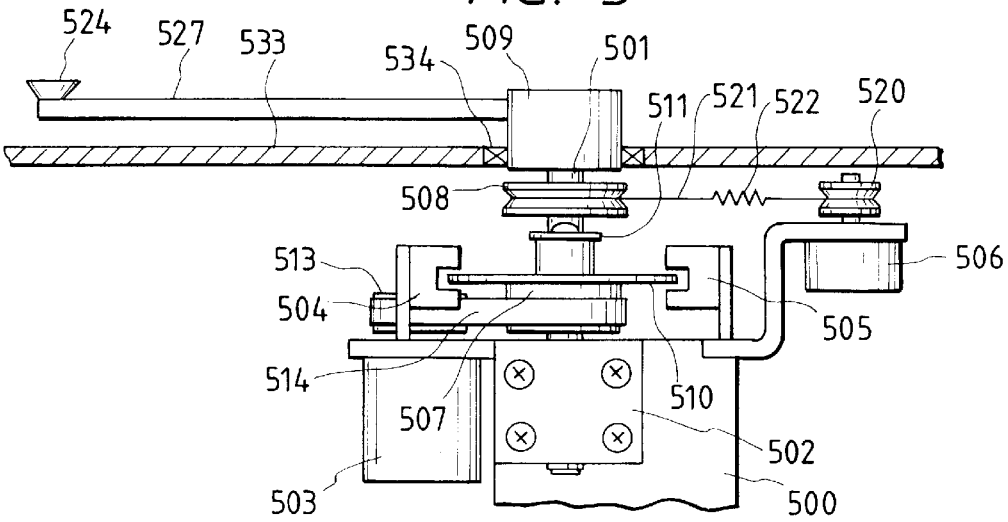
FIG. 5 is a cross-sectional view of the lens configuration measuring section.
Figure 6:
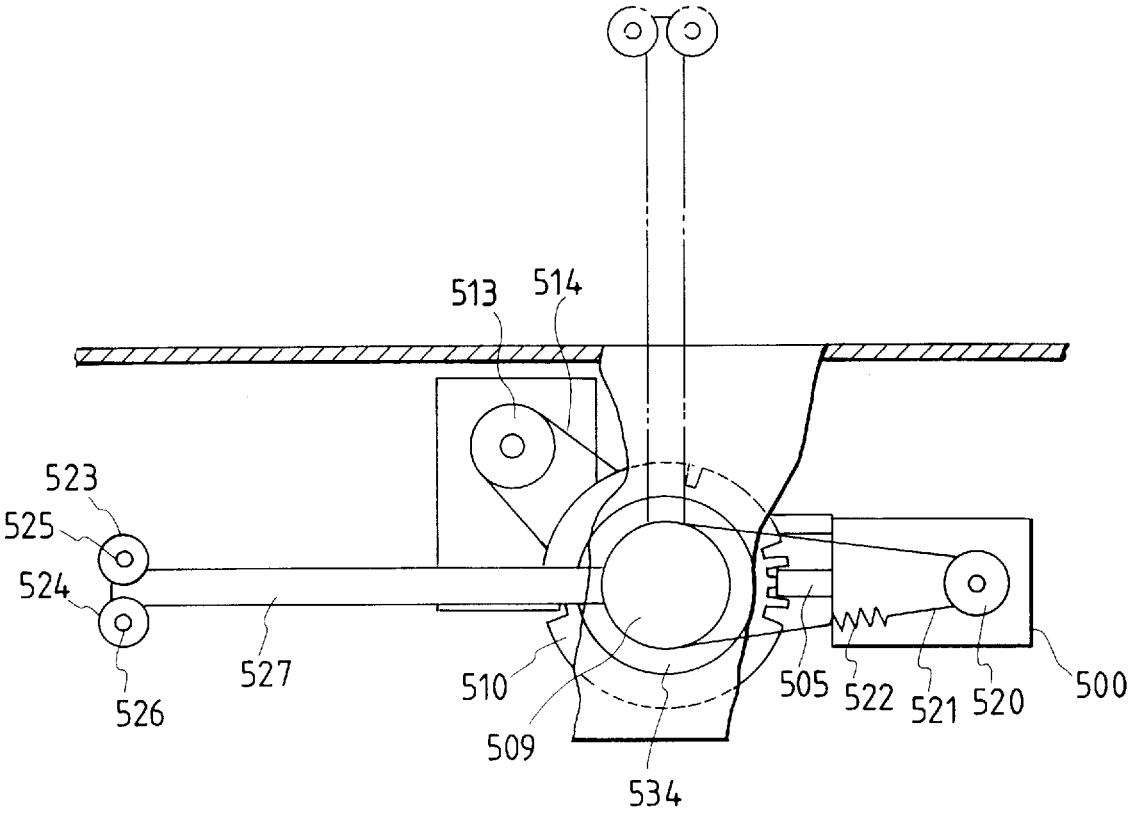
FIG. 6 is a plan view of the lens configuration measuring section.

FIG. 4 is a schematic diagram showing the general layout of the lens configuration measuring section. Details of its construction will now be described with reference to FIGS. 5 and 6. FIG. 5 is a cross-sectional view of the lens configuration measuring section 5, and FIG. 6 is a plan view of the same. A shaft 501 is rotatably mounted on a box 500 through the intermediation of a bearing 502. Further mounted on the box 500 are a DC motor 503, photoswitches 504 and 505, and a potentiometer 506. A pulley 507 is rotatably mounted on the shaft 501. Further mounted on the shaft 501 are pulley 508 and a flange 509. Mounted on the pulley 507 are a sensor plate 510 and a spring 511.

Figure 7:
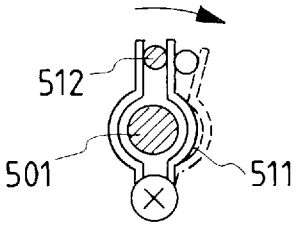
FIG. 7 is a diagram illustrating the operation of a spring and a pin.

As shown in FIG. 7, the spring 511 is attached to the pulley 507 such that it holds a pin 512. As a result, when the spring 511 rotates with the pulley 507, the spring 511 exerts a resilient force on the pin 512 to be rotated, which is attached to the rotatable pulley 508. If the pin 512 moves in, for example, the direction indicated by the arrow independently of the spring 511, the above-mentioned resilient force acts such as to restore the pin 512 to the original position.

Attached to the rotating shaft of the motor 503 is a pulley 513, and the rotation of the motor 503 is transmitted to the pulley 507 through a belt 514 stretched between the pulleys 513 and 507. The rotation of the motor 503 is detected and controlled by the photoswitches 504 and 505 through the sensor plate 510 attached to the pulley 507.

Rotation of the pulley 507 causes the pulley 508, to which the pin 512 is attached, to rotate, with the rotation of the pulley 508 being detected by the potentiometer 506 through a rope 521 stretched between the pulley 508 and a pulley 520, which is attached to the rotating shaft of the potentiometer 506. In this process, the shaft 501 and the flange 509 rotate simultaneously with the rotation of the pulley 508.

Feelers 523 and 524 are rotatably mounted on a measurement arm 527 by means of pins 525 and 526, the measurement arm 527 being attached to the flange 509. The photoswitch 504 detects the initial position and the measurement end position of the measurement arm 527. The photoswitch 505 detects the relief position and the measurement position of the feelers 523 and 524 with respect to the front refractive surface and the rear refractive surface of the lens LE.

In order to measure the lens configuration, the lens LE is rotated with the feeler 523 being allowed to abut against the front refractive surface of the lens LE (with the feeler 524 later similarly abutting against the rear refractive surface of the lens LE, as described later), whereupon the amount of rotation of the pulley 508 is detected with the potentiometer 506 to determine the configuration of the lens LE.

(C) Display Section and Input Section

Figure 8:
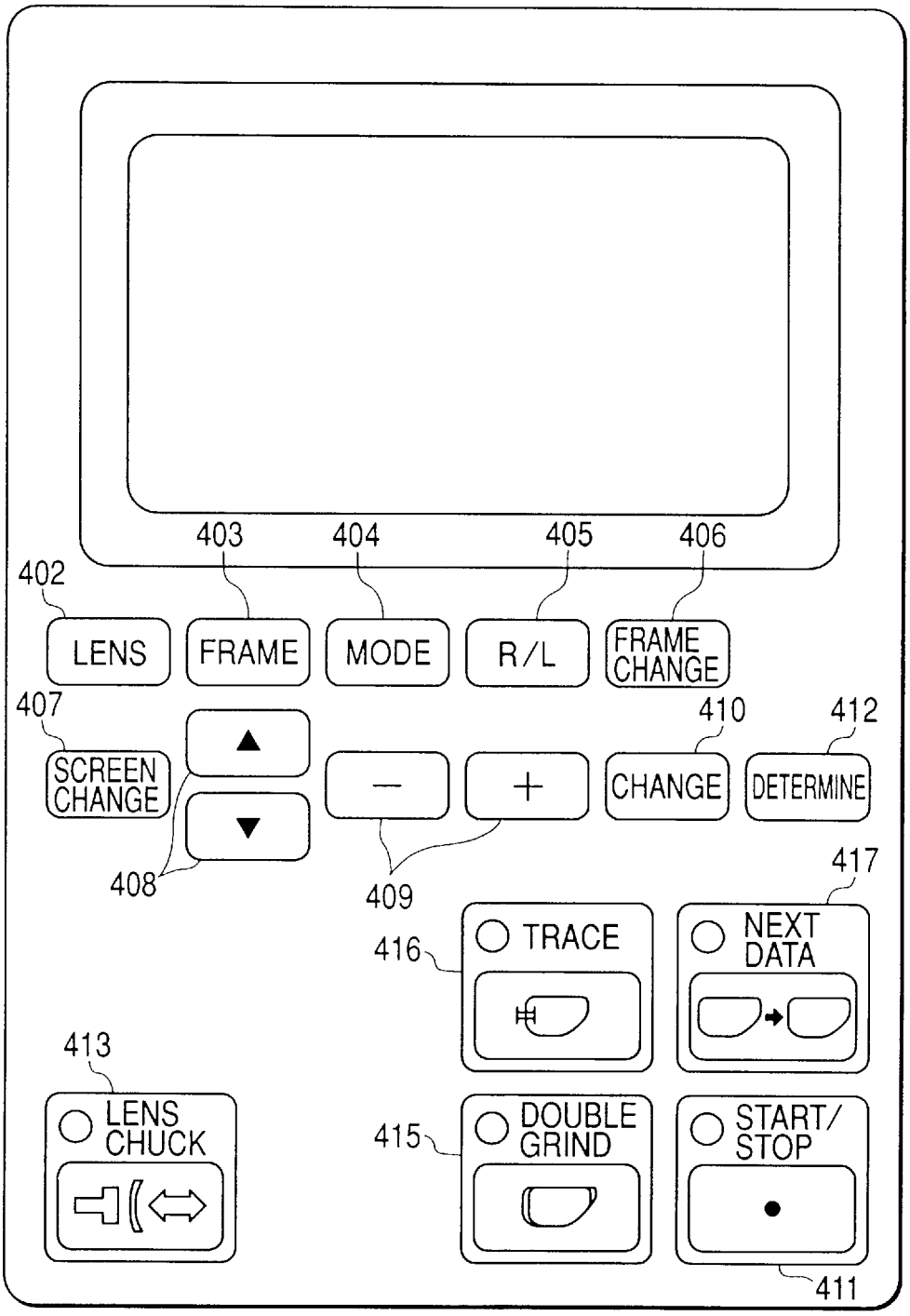
FIG. 8 is a diagram showing the outer appearance of display section 3 and input section 4.

FIG. 8 is a diagram showing the outer appearance of the display section 3 and the input section 4, which are formed as an integral unit. The input section 4 has the following switches: a LENS switch 402 for indicating whether the lens to be processed is made of a plastic or glass material; a FRAME switch 403 for indicating whether the frame is made of a resin or metal; a MODE switch 404 for selecting a plane processing mode or a tapered edge (bevel) machining mode; a R/L switch 405 for selecting which of the right- or left-eye lens is to be processed; a FRAME CHANGE switch 406 for turning on or off the Frame Change mode; a SCREEN CHANGE switch 407 for changing the screen to appear in the display section 3 (whether it displays a layout, a menu or parameters); cursor move switches 408 for moving the cursor appearing in the display section 3; (−) and (+) switches 409 used to enter numerals such as values of prescription; a CHANGE switch 410 typically used for changing the mode of layout entry; a START STOP switch 411 for starting or stopping the lens processing operation; a LENS CHUCK switch 413 for opening or closing the lens chucks; a DOUBLE GRIND switch 415 for activating double grinding (finishing); a TRACE switch 416 for giving a command for tracing the lens frame or template; and a NEXT-DATA switch 417 for transferring the data measured by the eyeglass frame configuration measuring section 2.

The display section 3 is formed of a liquid crystal display which is controlled to show set values of processing information, the tapered edge (bevel) simulation of the tapered edge (bevel) position and the fitting condition of the tapered edge (bevel) with the lens frame, the reference set values, and so forth, by means of a main arithmetic control circuit which will be described later.

(D) Electric Control System for the Grinding Machine

Figure 9:
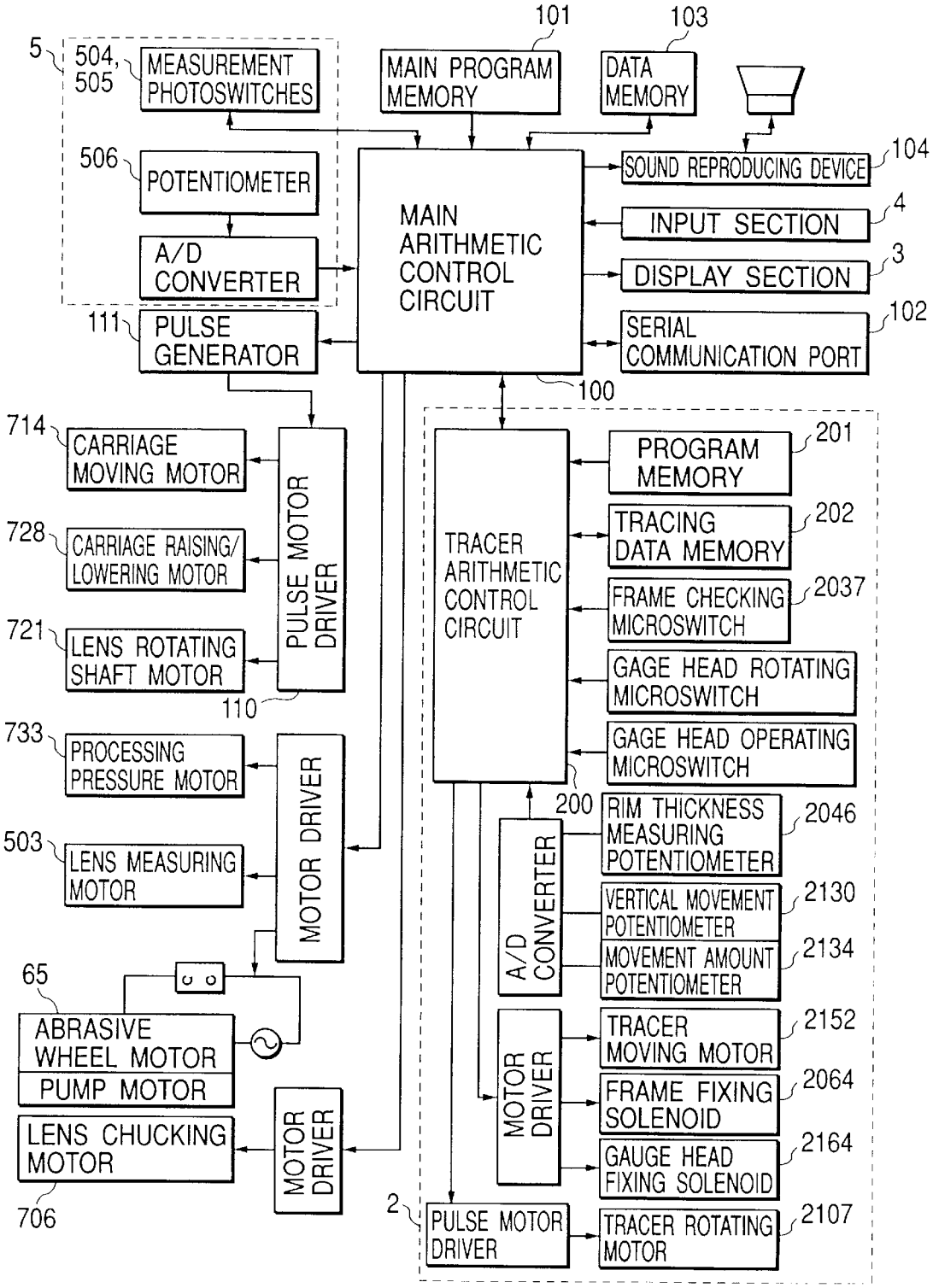
FIG. 9 shows the essential part of the block diagram of the electrical control system for the grinding machine.

FIG. 9 shows the essential part of a block diagram of the electric control system for the grinding machine. A main arithmetic control circuit 100 is typically formed of a microprocessor and is controlled by a sequence program stored in a main program memory 101. The main arithmetic control circuit 100 can exchange data with IC cards, eye examination system devices and so forth through a serial communication port 102, and perform data exchange and communication with a tracer arithmetic control circuit 200 of the eyeglass frame configuration measurement section 2. The eyeglass frame configurational data is stored in a data memory 103.

Connected to the main arithmetic control circuit 100 are the display section 3, input section 4, sound reproducing device 104, as well as the photoswitches 504 and 505 for measurement, DC motor 503 and potentiometer 506 in the lens configuration measuring device 5. The potentiometer 506 is connected to an A/D converter whose conversion results will be inputted into the main arithmetic control circuit 100. Measurement data of the lenses which have been arithmetically processed in the main arithmetic control circuit 100 are stored in a data memory 103. A carriage moving motor 714, a carriage raising/lowering motor 728 and a lens rotating shaft motor 721 are connected to the main arithmetic control circuit 100 through a pulse motor driver 110 and a pulse generator 111. The pulse generator 111 determines the pulse number and the frequency (Hz) of the output to the respective pulse motors, i.e., controls the operation of the respective motors, in response to commands from the main arithmetic control circuit 100.

The operation of the grinding machine having the above-described construction will be explained below.

Operation of Processing Lens

Figure 10A:
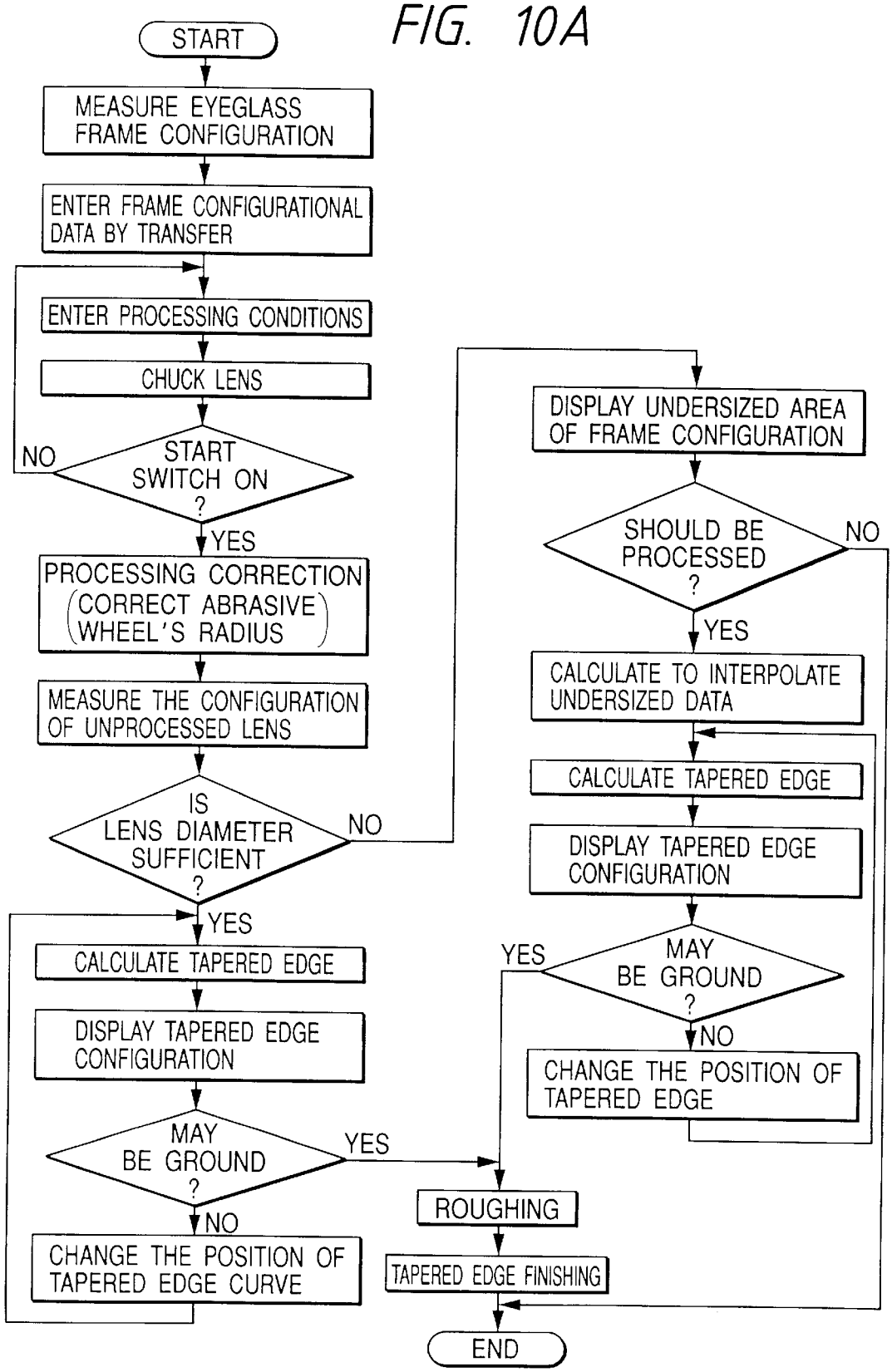
FIG. 10A is a flowchart showing an exemplary sequence of steps for processing the lens.

The operation of processing a lens (when the Frame Change mode is not selected) is explained with reference to the flowchart shown in FIG. 10A. First, an eyeglass frame (or template) is set on the eyeglass frame configuration measuring device 2 and the TRACE switch 416 is pressed to start tracing. The radius vector information on the eyeglass frame as obtained from the eyeglass frame configuration measuring device 2 is stored in the internal trace data memory 202. When the NEXT-DATA switch 417 is pressed, the traced data is entered by transfer into the grinding machine and stored in the data memory 103. At the same time, a graphic representation of the frame configuration appears on the screen of the display section 3 based on the eyeglass frame data and the machine is ready for receiving the necessary processing conditions. The data to be stored in the data memory 103 may be supplied from storage media such as an IC card or transferred on-line from a separate computer.

In the next step, the operator touches various switches in the input section 4 to enter the necessary information including the constituent material of the lens to be processed, the constituent material of the frame, whether the lens to be processed is for the right eye or the left eye and whether the processing to be performed is plane processing or tapered edge (bevel) machining. The following description assumes that a command for tapered edge (bevel) machining is entered. In addition, the operator writes the value of PD (pupillary distance) according to the prescription and the height of the optical center of the lens into the ENTRY window appearing on the display screen in a specified position by manipulating the cursor move switches 408 and (−)/(+) switches 409.

With the entry of the necessary processing conditions being complete, specified actions (e.g. axial alignment of suction cups) are taken so that the lens LE to be processed is chucked by the lens rotating shafts 704*a* and 704*b*. Thereafter, the START/STOP switch 411 is pressed to bring the grinding machine into operation.

Figure 11:
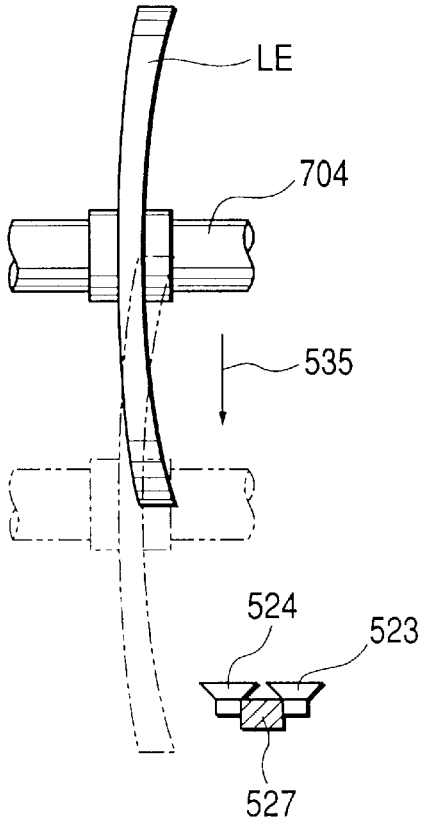
FIG. 11 is a diagram for explaining the measuring operation of a lens configuration measuring device.

In response to an input start signal, the grinding machine performs arithmetic operations for processing correction (the correction of the abrasive wheel's radius) (see U.S. Pat. No. 5,347,762) and subsequently measures the lens configuration by the following procedure. First, the lens rotating shaft motor 721 is run to rotate the lens shafts 704*a* and 704*b* such that the radius vector angle ($r_s\theta_n$) of the radius vector information ($r_s\delta_n$, $r_s\theta_n$) based on the eyeglass frame configurational data is directed to the center of rotation of the abrasive wheel. Thereafter, the motor 714 for moving the carriage 700 back and forth is run until the carriage 700 is moved to the reference position for measurement at the left end of the carriage stroke. In the next step, the motor 503 controlled by the photoswitch 505 in the lens configuration measuring device 5 is rotated until the measurement arm 527 has rotated from the initial position to the relief position with respect to the rear refractive surface of the lens LE as shown in FIG. 11. Subsequently, the motor 728 is run to move the lens LE in the direction of arrow 535 such that it comes close to the feeler 524. The lens movement stops in such a position that the feeler 524 barely touches an imaginary line that is assumed as the locus of the distal end (or bottom or inclined side) of the tapered edge (bevel) of the lens LE on the basis of the radius vector information. Thereafter, the motor 503 is run to rotate the measurement arm 527 until it comes to the position for measurement of the rear side of the lens LE such that the feeler 524 is urged against the lens LE. The feeler 524 has an urging force provided by the spring 511 which is flexible enough to follow the positional changes in the surface of contact with the lens LE.

After this state has been attained, the motor 721 is driven to rotate the lens LE and, at the same time, the motor 728 is controlled on the basis of the radius vector information to change the lens movement in the direction of arrow 535. As a result, the feeler 524 traces the advancing end of the imaginary locus of the distal end (or bottom) of the tapered edge (bevel) of the lens LE, whereupon the potentiometer 506 detects the amount of movement of the feeler 524 in terms of the amount of rotation of the pulley 508 and the configuration of the rear refractive surface of the lens LE is determined from the issued detection signal. By monitoring the resulting data of measurement, the grinding machine determines whether the lens diameter is sufficient for the configuration of the eyeglass frame. If the lens diameter is insufficient, causing the feeler 524 to come out of engagement with the rear surface of the lens LE during measurement of the lens configuration, an abrupt change will occur in the data of measurement (i.e., the amount of movement of the feeler 524), enabling the machine to know that the lens diameter is insufficient. If the data of measurement has no abrupt change at any point of time in the measurement, the lens diameter is considered to be sufficient and the machine obtains the configuration of the rear refractive surface of the lens LE for the entire periphery.

After the lens LE has made a full rotation to provide the configuration of the rear refractive surface of the lens LE for the entire periphery, the carriage 700 is returned to the initial position where the measurement was started. In the next step, the motor 503 is driven to rotate the measurement arm 527 to the relief position for measurement of the front refractive surface of the lens LE, which is then moved to the position of measurement. With the lens LE making a full rotation, the feeler 523 traces the imaginary locus of the tapered edge (bevel) and, as in the measurement of the rear refractive lens surface, the configuration of the front refractive surface is determined for the entire periphery in terms of the amount of movement of that feeler 523.

If an abrupt change occurs in the monitored data of measurement and the lens LE is found to be undersized, the machine continues the measurement in the following manner. As soon as an abrupt change occurs in the data of measurement, the rotation of the lens LE is stopped and the carriage 700 is returned to the initial position where the measurement started and, in addition, the measurement arm 527 is returned to the relief position. Thereafter, as in the start of measurement, the lens shafts 704*a* and 704*b* are rotated such that the radius vector angle ($r_s\theta_n$) of the radius vector information is directed to the center of rotation of the abrasive wheel, and the carriage 700 is again moved on the basis of the radius vector information until it is placed in the rotation start position. The measurement arm 527 is moved until the feeler 524 is urged against the lens LE. The lens LE is then rotated in a reverse direction, thereby determining the configuration of the rear refractive surface of the lens LE as seen in opposite direction. If, upon this reverse rotation, an abrupt change occurs again in the amount of movement of the feeler 524, the rotation of the lens LE is stopped and the carriage 700 is returned to the initial position, thereby completing the measurement of the rear lens surface. In this way, the grinding machine determines the configuration of the rear refractive surface of the lens LE excepting the undersized area where the lens diameter is insufficient relative to the eyeglass frame configurational data.

The same procedure is followed to measure the front surface of the lens LE. By rotating the lens LE in forward and reverse directions, the configuration of the front refractive surface of the lens LE excepting the undersized area is determined.

Figure 12:
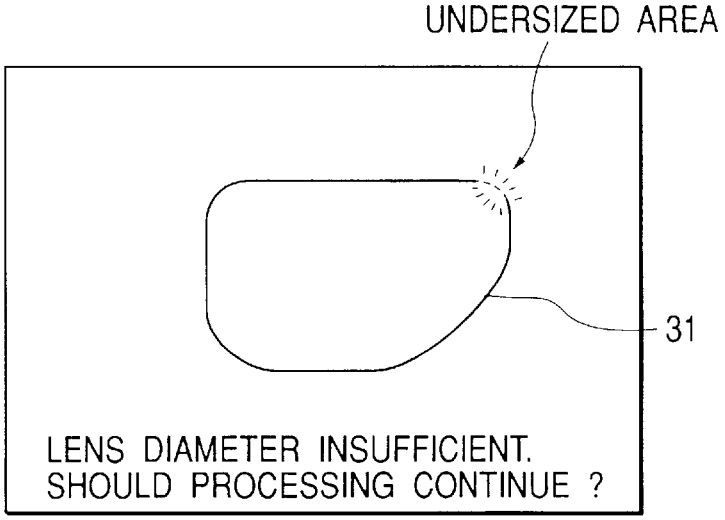
FIG. 12 shows an exemplary image which appears in the display section when the diameter of the lens to be processed is insufficient.

If the lens diameter is insufficient after the end of measurement, the display section 3 gives a graphic representation of the frame configuration 31, with the undersized area blinking as shown in FIG. 12 (the undersized area may be indicated by a predetermined convention such as a symbolic mark). In addition, a relevant message stating, for example, "LENS DIAMETER INSUFFICIENT. SHOULD PROCESSING CONTINUE?" will appear on the screen. This will give the operator the exact information about the undersized area of the lens LE and its extent, thereby helping him to determine whether the lens LE processing should be continued or not. In the former case, the operator presses the START/STOP switch 411 to bring the machine into operation.

Figure 10B:
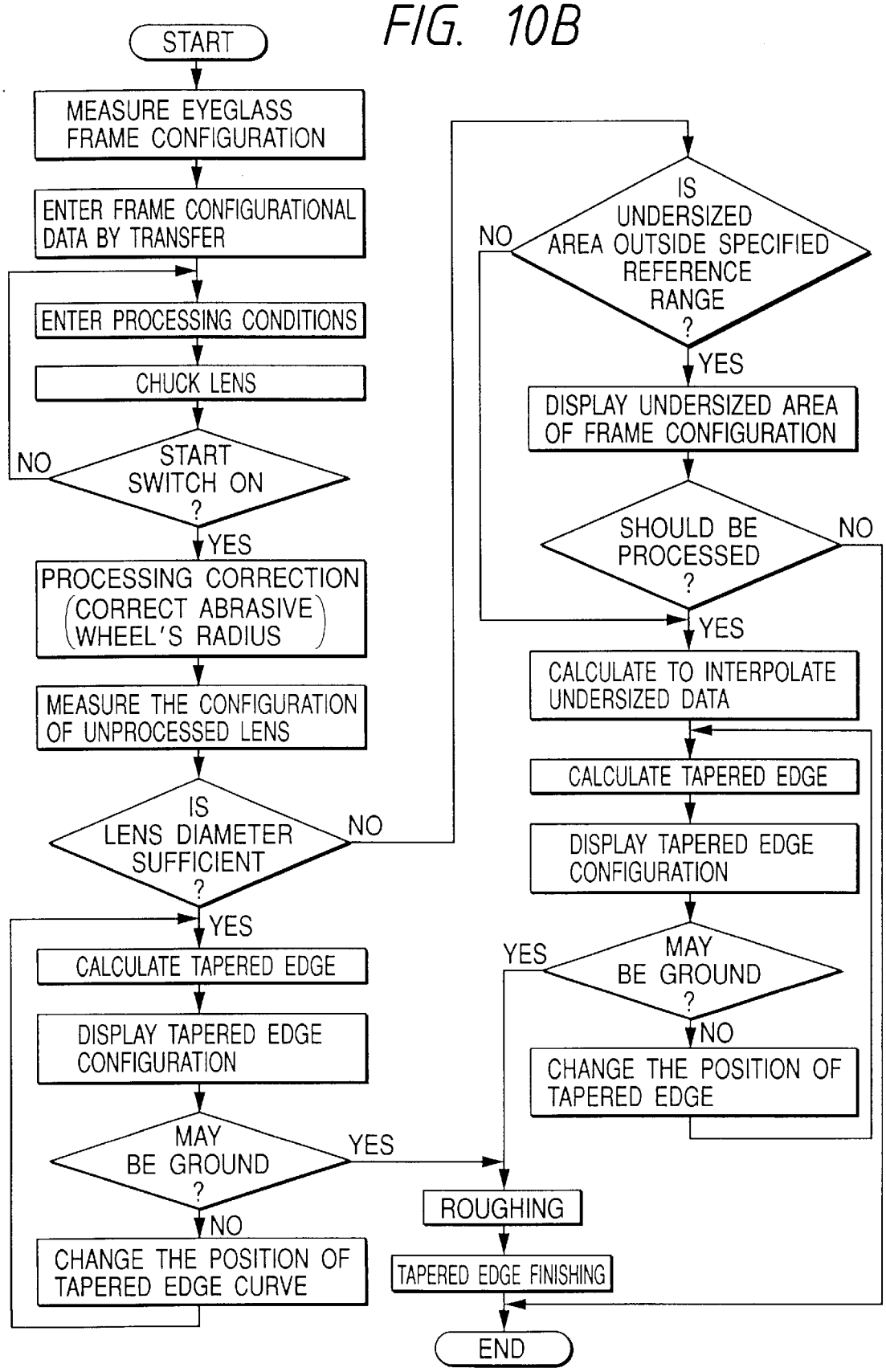
FIG. 10B is a flowchart showing a modified sequence of steps for processing the lens.

Alternatively, the machine may be so adapted that it determines whether the undersized area of the lens LE is outside a specified range (reference range) and that it proceeds to the subsequent processing step automatically if the undersized area is within the reference range (see FIG. 10B) (or only when the Frame Change mode has been entered). If desired, the machine may be so adapted that depending on the initial setting, it will automatically continue the processing on the basis of the result of determination or the operator uses his own discretion in making a decision. Determination as to whether the lens diameter is insufficient may be made independently of the data for making tapered edge (bevel) calculations (for tapered edge (bevel) calculations, the bevelled bottom may be measured whereas various positions of the apex of the tapered edge (bevel) are measured to know the insufficiency of lens diameter; alternatively, data for knowing the insufficiency of lens diameter may be obtained by measurement with a separate device from the lens measuring device).

When the START/STOP switch 411 is pushed (or if the processing is performed automatically on the basis of determination by the machine itself), the grinding machine performs interpolation of the undersized areas for the edge positions of the front and rear refractive surfaces of the lens LE.

Figure 13A:
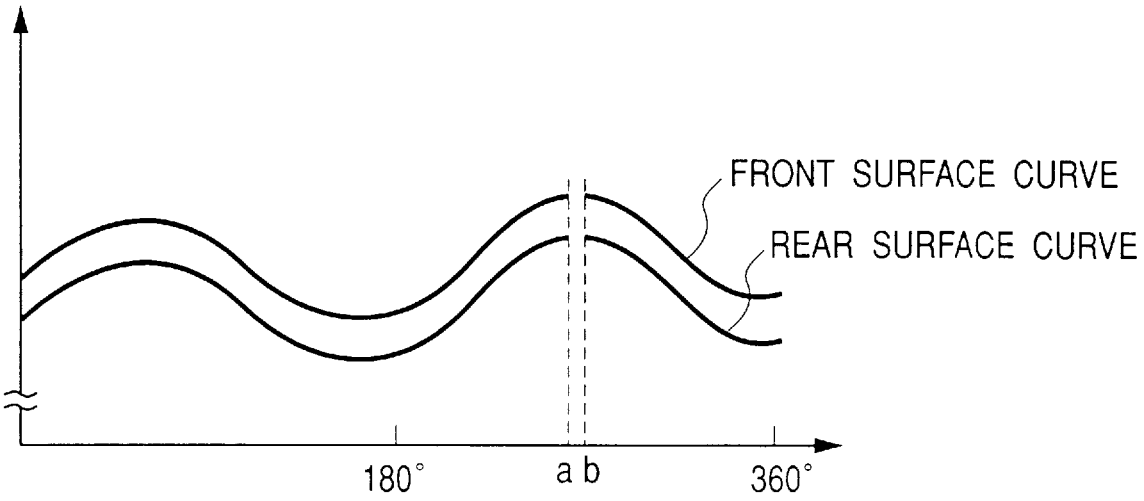
FIG. 13*a* is a diagram showing the edge positions of the front and rear refractive lens surfaces as relative to the radius vector angle.
Figure 13B:
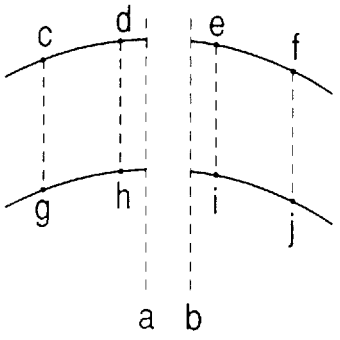
FIG. 13*b* is a diagram illustrating how the undersized area a-b is interpolated by splining.

The method of interpolating the undersized areas will now be described. FIG. 13*a* shows the edge position of each of the front and rear refractive surfaces of the lens LE as relative to the radius vector angle, and the undersized area is indicated by the interval between angles a and b. The undersized area for the edge position of the front lens surface may be interpolated by splining using a spline function. In the method of interpolation by splining, a given interval to be approximated is divided into a plurality of subintervals and polynomials are applied to the respective subintervals to determine a curve which, taken as a whole, passes through the given points such that the differential coefficients of the first and second orders match up with each other at those points. Using this method and on the basis of the data of measurement for certain angles c, d, e and f which embrace the undersized area a-b (see FIG. 13*b*), a spline curve connecting points a and b smoothly is determined to fill up the configurational data for the undersized area a-b. In this method of interpolation by splining, the coordinates of three sample points will suffice to construct a smooth curve connecting said three points; however, it is preferred to use the data of measurement for four points, two points on either side of the undersized area (more sample points may be selected). The same method may be applied to the undersized area for the edge position of the rear lens surface and the data of measurement at certain angles g, h, i and j embracing the undersized area a-b is subjected to splining to fill up the configurational data for the undersized area.

Instead of using the data of measurement for a limited area including the undersized area, all of the data of measurement obtained may be divided (into equal intervals) at given spacings and the end points of the respective intervals are connected by splining to interpolate the data for the undersized area. This method offers the advantage of creating a curve for the undersized area that has good fit to the general tendency of the lens configuration.

The method of interpolation of the undersized area is not limited to splining; conveniently, the undersized area may be obtained by linear interpolation and any other known methods of interpolation may be adopted.

After filling up the undersized areas by the above-described method of interpolation to provide the configurations (edge positions) of the front and rear refractive surfaces of the lens LE along the entire periphery, tapered edge (bevel) calculations are performed on the basis of such information in order to determine the position of the apex of the tapered edge (bevel) for establishing the intended tapered edge (bevel). In the embodiment under consideration, the position of the apex of the tapered edge (bevel) is calculated with a certain ratio being set for the edge thickness. The position of the apex of the tapered edge (bevel) need not be calculated on the basis of a specified ratio; instead, the position of the apex of the tapered edge (bevel) may be shifted from the edge position of the front lens surface toward the rear surface by a certain amount such that the same tapered edge (bevel) curve as the curve of the front surface will be established; this and other methods of tapered edge (bevel) calculation are described in U.S. Pat. No. 5,347,762.

When the tapered edge (bevel) calculations have been completed, the display section 3 shows the tapered edge (bevel) configuration for the position at a minimal edge thickness, which appears just beside the display of the frame configuration 31. By moving the cursor appearing in the display of the frame configuration 31, the operator can see the configuration of the tapered edge (bevel) for a designated site. If there is any undersized area of the lens LE (where the lens diameter is insufficient), the displayed tapered edge (bevel) configuration does not include the undersized area.

The operator checks the displayed tapered edge (bevel) configuration and if there is no problem he will push the START/STOP switch 411. On the basis of the eyeglass frame configurational data and the processing data obtained by tapered edge (bevel) calculations, the machine controls the carriage section 7 and the lens grinding section 6 such as to perform processing in the order of roughing and tapered edge (bevel) finishing (in AUTO PROCESSING mode, the machine performs processing automatically after the position of the apex of the tapered edge (bevel) has been calculated). Thus, even in the presence of insufficiency in lens diameter, the undersized area is interpolated and the necessary tapered edge (bevel) calculations are performed to enable the lens processing.

Figure 10C:
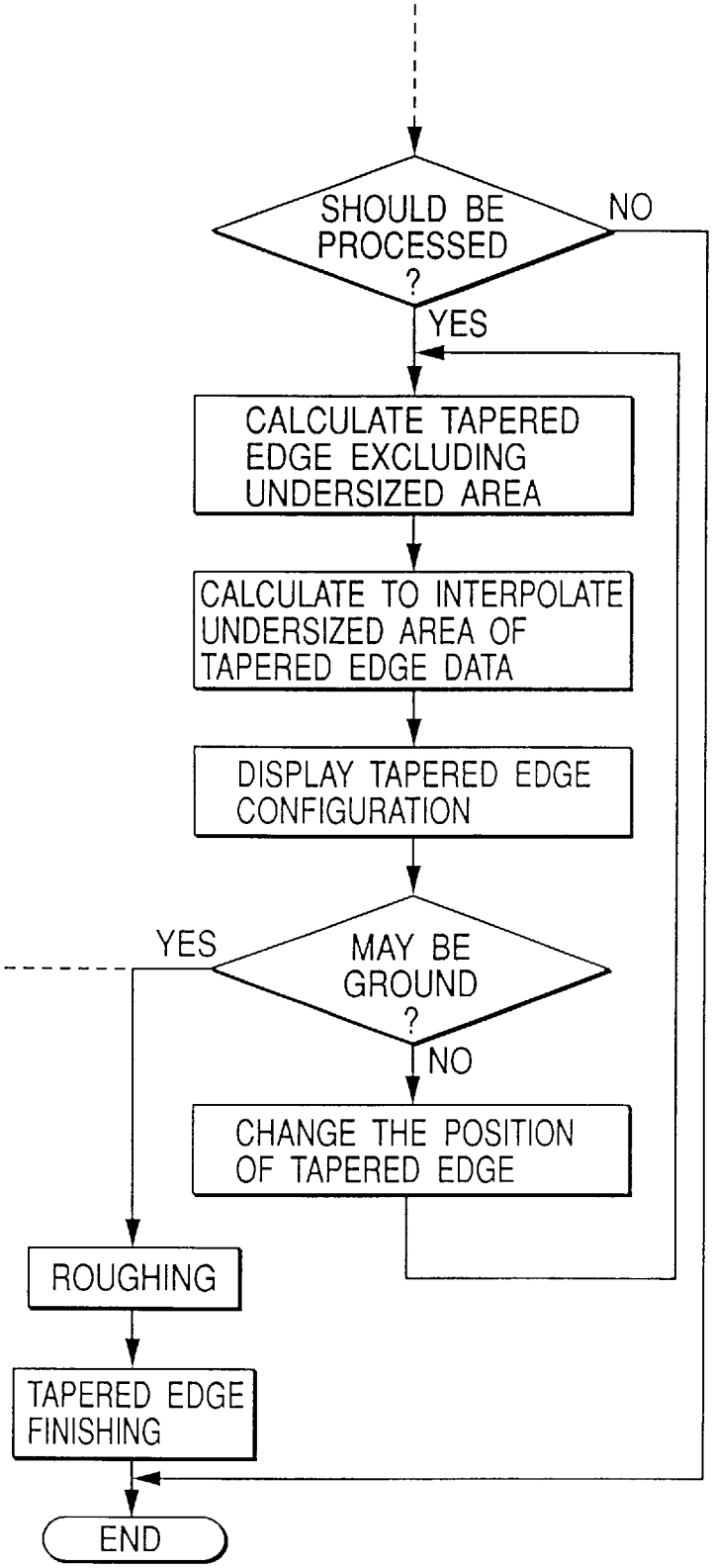
FIG. 10C is a flowchart showing another modified sequence of steps for processing the lens.

The foregoing explanation assumes that in the presence of insufficiency in lens diameter, the undersized areas for the edge positions of both the front and rear surfaces of the lens LE are interpolated before tapered edge (bevel) calculations are performed. Alternatively, the interpolation may be performed in the following manner. Take, for example, the case of performing tapered edge (bevel) calculations on the basis of a certain ratio, say, 5:5. In this case, tapered edge (bevel) data is first obtained from the configurations of the front and rear lens surfaces excepting the undersized areas (see FIG. 10*c*). The insufficiency of the thus obtained tapered edge (bevel) data (i.e., tapered edge (bevel) curve) is interpolated by a suitable method such as splining. Tapered edge (bevel) calculations may also be performed using spherical curves (for both the rear and front lens surfaces); in this case, the spherical curves are computed with the necessary data of measurement being selected such as to avoid the undersized areas and the edge positions of the undersized areas are then interpolated on the basis of the computed values for the spherical curves and the given radius vector information. The data for the spherical curves need not be calculated on the basis of measurement of the lens configuration; if the data on the spherical curves of the lens LE to be processed is already known, it may be entered into the machine to determine the edge positions of the undersized areas of the lens LE.

Frame Change Mode

We now describe the operation of the machine in the case where it has selected Frame Change mode. The following description centers on the differences from the processing when the Frame Change mode is not selected. A new eyeglass frame is traced by means of the eyeglass frame configuration measuring device 2 and the NEXT/DATA switch 417 is pressed to have the new frame data stored into the data memory 103. Subsequently, the operator pushes the FRAME CHANGE switch 406 to turn on the Frame Change mode and thereafter pushes the START/STOP switch 411 to start processing correction and lens configuration measurement.

Figure 14:
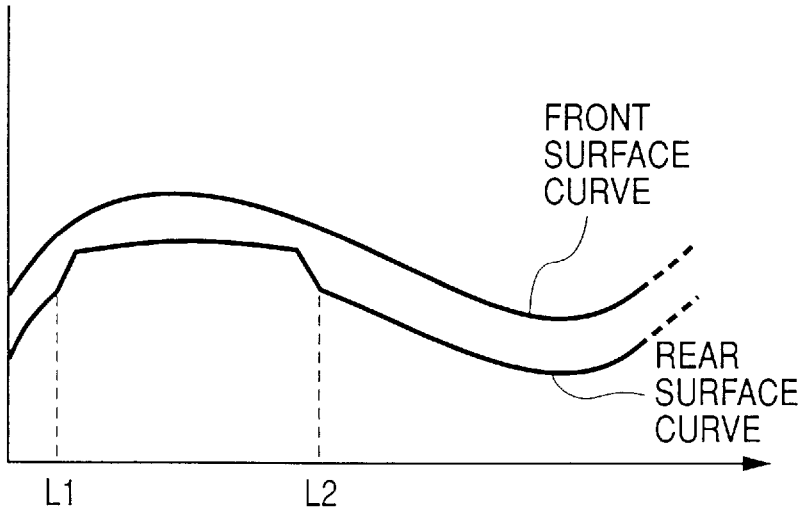
FIG. 14 is a diagram showing an exemplary display of the information on the edge position in the presence of an incomplete interval.

In the Frame Change mode, lens measurement is performed in areas a specified distance (1.5 mm) inward of the radius vector length in the radius vector information for the lens frame configurational data, thereby obtaining lens configurational data for the front and rear lens surfaces in the same manner as described above in connection with the processing when the Frame Change mode is not selected (if the lens diameter is found to be insufficient, configurational data excluding the undersized areas will be obtained). In the Frame Change mode, the lens LE to be measured has already been processed to establish a tapered edge (bevel), so if the feeler 524 abuts against the inclined surface of the tapered edge (bevel), an incomplete interval will appear as defined by L1 and L2 in FIG. 14. After the measurement of lens configuration (if the lens diameter is insufficient, the undersized area is displayed as shown in FIG. 12 and a switch signal dictating continued processing is entered and then), edge position information appears in the display section 3 as shown in FIG. 14 (for the case where the curve of the rear lens surface contains an incomplete interval). The operator manipulates the data of measurement and moves the cursor to designate an incomplete interval such as one defined by L1 and L2. When the (−) switch is pressed, the cursor moves to the left of the screen and if the (+) switch is pressed, it moves to the right. The DETERMINE switch 412 is then pushed to designate the start and end points of the incomplete interval. With the incomplete interval being thusly designated, the machine eliminates it from the data of measurement and performs interpolation by one of the methods already described above, and executes tapered edge (bevel) calculations (which should include the correction of the result of measurement of the lens configuration which was performed inward by a specified distance). A similar interpolation process may be applied if the lens LE has undersized areas.

After the tapered edge (bevel) calculations, a tapered edge (bevel) position is displayed in the same manner as in the case that the Frame Change mode is not selected and when the START/STOP switch 411 is pressed, rough processing is performed and, thereafter, tapered edge (bevel) finishing is executed on the basis of the tapered edge (bevel) data.

In the embodiment described above, the edge positions and the undersized areas of the lens LE are detected by measuring the edge equivalent positions of the lens LE with the lens configuration measuring device. However, this is not the sole case of the invention and even in the absence of data obtained from the lens configuration measuring device, the invention can of course be implemented by entering the data on the configuration of the eyeglass lens to be processed (e.g., center thickness and the curves of the front and rear surfaces).

If the lens LE to be processed contains a certain area where in view of the result of measurement of edge position, a tapered edge (bevel) cannot certainly be established, there is no need to perform complicated procedures of interpolation.

Yet another modification of the embodiment is as follows. The lens configuration measuring device usually measures lens positions other than the bottom of the tapered edge (bevel). Alternatively, the position of the tapered edge (bevel) bottom may be measured at the point of time when an insufficiency of lens diameter is detected and if the measurement is successful, tapered edge (bevel) calculations are performed on the basis of the measured data; if the machine has such a mechanism that it checks the lens diameter while measuring the tapered edge (bevel) bottom, tapered edge (bevel) calculations may be performed on the basis of the data for the tapered edge (bevel) bottom; in both cases, the lens diameter is insufficient and yet the machine automatically gives a command to form a tapered edge (bevel) or the operator uses his own discretion (on the basis of such information as displayed data) to give the same command.

As described on the foregoing pages, the embodiment of the present invention offers an advantage in that even if the lens being processed is insufficient in diameter to be fitted into eyeglass frames, the operator can perform the processing if he so desired.

If the lens configuration measuring device is adapted to measure lens positions other than the bottom of the tapered edge (bevel), the invention offers a greater possibility for processing the tapered edge (bevel) to the desired shape even if it has an incomplete interval.

What is claimed is:

1. An eyeglass lens grinding machine for processing lenses to be fitted in an eyeglass frame, comprising:

means for inputting frame configurational data of an eyeglass frame;

means for inputting layout data to be used in providing layout of a lens corresponding to an eyeglass frame;

means for determining layout of the lens based on the frame configurational data input by said means for inputting frame configurational data and the layout data input by said means for inputting layout data;

means for obtaining an edge position of the lens in thickness direction based on the layout determined by said determining means;

means for computing lens processing data based on the layout determined by said determining means and the edge position obtained by said obtaining means;

means for detecting an insufficiency in the diameter of the lens relative to the lens processing data computed by said computing means;

means for setting predetermined reference range relative to an insufficiency in the diameter of the lens;

means for judging whether or not an insufficiency detected by said detecting means is within the predetermined reference range set by said setting means; and means for entering a processing command signal based on a result judged by said judging means, wherein when said detecting means detects the insufficiency and said entering means enters the processing command signal despite the insufficiency, a grinding operation is performed with the insufficiency left, based on the lens processing data computed by said computing means.

2. An eyeglass lens grinding machine according to claim 1, further comprising means for displaying a graphic representation of the insufficiency in the diameter of the lens based on an output of said detecting means.

3. An eyeglass lens grinding machine according to claim 1, further comprising means for deciding whether or not to perform the grinding operation despite the insufficiency, based on the result judged by said judging means, wherein a result decided by said deciding means is utilized for entering the processing command signal in order to perform the grinding operation despite the insufficiency.

4. An eyeglass lens grinding machine for processing lenses to be fitted in an eyeglass frame, comprising:

means for inputting frame configurational data of an eyeglass frame;

means for inputting layout data to be used in providing layout of a lens corresponding to an eyeglass frame;

means for determining layout of the lens based on the frame configurational data input by said means for inputting frame configurational data and the layout data input by said means for inputting layout data;

means for obtaining an edge position of the lens in thickness direction based on the layout determined by said determining means;

means for computing lens processing data based on the layout determined by said determining means and the edge position obtained by said obtaining means;

means for detecting an insufficiency in the diameter of the lens relative to the lens processing data computed by said computing means;

means for interpolating the lens processing data for a portion of the lens having the insufficiency detected by said detecting means, based on the lens processing data for a portion of the lens excluding the portion of the lens having the insufficiency, computed by said computing means; and means for executing a grinding operation based on the lens processing data computed by said computing means and interpolated by said interpolating means.

5. An eyeglass lens grinding machine according to claim 4, wherein said means for obtaining comprises a gage head for contacting front and rear surfaces of the lens.

6. An eyeglass lens grinding machine according to claim 4, wherein said means for obtaining comprises a gage head for contacting front and rear surfaces of the lens, and means for detecting movement of said gage head, wherein the insufficiency is detected based on an output of said means for detecting movement of said gage head.

7. An eyeglass lens grinding machine according to claim 6, further comprising means for rotating said gage head, relative to the lens, in forward and reverse directions from a predetermined point on the lens.

8. An eyeglass lens grinding machine according to claim 4, further comprising means for displaying a graphic representation of the insufficiency in the diameter of the lens based on an output of said detecting means.

9. An eyeglass lens grinding machine according to claim 8, further comprising means for entering a processing command signal.

10. An eyeglass lens grinding machine according to claim 4, further comprising means for judging whether a range of the insufficiency detected by said detecting means exceeds a predetermined reference value, and means for outputting a processing command signal when the range of the insufficiency does not exceed the predetermined reference value.

11. An eyeglass lens grinding machine for processing lenses to be fitted in an eyeglass frame, comprising:

means for inputting frame configurational data of an eyeglass frame;

means for inputting layout data to be used in providing layout of a lens corresponding to an eyeglass frame;

means for determining layout of the lens based on the frame configurational data input by said means for inputting frame configurational data and the layout data input by said means for inputting layout data;

means for obtaining an edge position of the lens in thickness direction based on the layout determined by said determining means;

means for computing data for processing a tapered edge of the lens based on the layout determined by said determining means and the edge position obtained by said obtaining means;

means for detecting an insufficiency in the diameter of the lens relative to the data computed by said computing means;

means for setting predetermined reference range relative to an insufficiency in the diameter of the lens;

means for judging whether or not an insufficiency detected by said detecting means is within the predetermined reference range set by said setting means; and means for entering a processing command signal based on a result judged by said judging means, wherein when said detecting means detects the insufficiency and said entering means enters the processing command signal, a grinding operation is performed with the insufficiency left, based on the lens processing data computed by said computing means.

12. An eyeglass lens grinding machine according to claim 11, further comprising means for displaying a graphic representation of the insufficiency in the diameter of the lens based on an output of said detecting means.

13. An eyeglass lens grinding machine according to claim 11, wherein said computing means computes the data for processing the tapered edge of the lens based on a position of an edge of the lens excluding a portion of the lens having the insufficiency detected by said detecting means.

14. An eyeglass lens grinding machine according to claim 11, wherein said computing means computes first data for processing the tapered edge for a portion of the lens excluding a portion of the lens having the insufficiency and interpolates second data for processing the tapered edge for the portion of the lens having the insufficiency, based on the computed first data.

15. An eyeglass lens grinding machine according to claim 11, further comprising means for deciding whether or not to perform the grinding operation despite the insufficiency, based on the result judged by said judging means, wherein a result decided by said deciding means is utilized for entering the processing command signal in order to perform the grinding operation despite the insufficiency.

* * * * *